US008693853B2

(12) United States Patent
Olver et al.

(10) Patent No.: US 8,693,853 B2
(45) Date of Patent: Apr. 8, 2014

(54) RADIANT TUBE

(75) Inventors: John W. Olver, Blacksburg, VA (US); Jason Simmons, Blacksburg, VA (US)

(73) Assignee: Emisshield, Inc., Blacksburg, VA (US)

( * ) Notice: Subject to any disclaimer, the term of this patent is extended or adjusted under 35 U.S.C. 154(b) by 1023 days.

(21) Appl. No.: 12/679,296

(22) PCT Filed: Sep. 19, 2008

(86) PCT No.: PCT/US2008/077057

§ 371 (c)(1), (2), (4) Date: Mar. 19, 2010

(87) PCT Pub. No.: WO2009/039399

PCT Pub. Date: Mar. 26, 2009

(65) Prior Publication Data

US 2010/0303452 A1 Dec. 2, 2010

Related U.S. Application Data

(60) Provisional application No. 60/974,408, filed on Sep. 21, 2007.

(51) Int. Cl.
*F24C 7/00* (2006.01)

(52) U.S. Cl.
USPC ..... 392/407; 392/411; 392/424

(58) Field of Classification Search
USPC ..... 392/407–440
See application file for complete search history.

(56) References Cited

U.S. PATENT DOCUMENTS

| | | | | | |
|---|---|---|---|---|---|
| 3,663,798 | A * | 5/1972 | Speidel et al. | 219/452.12 |
| 4,479,535 | A * | 10/1984 | Echigo et al. | 165/142 |
| 4,673,350 | A * | 6/1987 | Collier | 431/353 |
| 4,727,854 | A * | 3/1988 | Johnson | 126/92 B |
| 4,800,866 | A * | 1/1989 | Finke | 126/91 A |
| 4,979,491 | A * | 12/1990 | DeMeritt | 126/92 B |
| 5,016,610 | A * | 5/1991 | Meguro et al. | 126/91 A |
| 5,127,826 | A * | 7/1992 | Acton et al. | 431/350 |
| 5,163,416 | A * | 11/1992 | Schultz et al. | 126/92 R |
| 5,224,542 | A * | 7/1993 | Hemsath | 166/59 |
| 5,224,857 | A * | 7/1993 | Schultz et al. | 432/175 |
| 5,626,125 | A * | 5/1997 | Eaves | 126/91 A |
| 5,981,920 | A * | 11/1999 | Kelly | 219/544 |
| 5,992,409 | A * | 11/1999 | Heimlich et al. | 126/91 A |
| 6,027,333 | A * | 2/2000 | Fujii et al. | 431/215 |
| 6,321,743 | B1 * | 11/2001 | Khinkis et al. | 126/91 A |
| 6,489,553 | B1 * | 12/2002 | Fraas et al. | 136/253 |
| 6,769,909 | B2 * | 8/2004 | Schwartz | 432/175 |
| 6,921,431 | B2 * | 7/2005 | Evans et al. | 106/287.34 |

* cited by examiner

*Primary Examiner* — Thor Campbell
(74) *Attorney, Agent, or Firm* — Mary-Jacq Holroyd; Johnston Holroyd

(57) ABSTRACT

A radiant tube assembly (12) has at least one tubular structure (14, 16, 22, or 24), and a heat source (30), with a thermal protective layer (18) is on at least one side, interior or exterior (17 or 15), thereof. An outer tubular structure (16) may be present. A protective layer (18) may be disposed on the outer tubular structure's (16) interior and/or exterior sides (17 and/or 15). A shield (26), having two sides (25 and 27) and a thermal protective layer (18) may be disposed along an exterior or interior side (27 or 25).

21 Claims, 4 Drawing Sheets

RADIANT TUBE

RELATED APPLICATIONS

This application claims the benefit of U.S. Provisional Application Ser. No. 60/974,408 entitled "RADIANT TUBE" filed on 21 Sep. 2007, the contents of which are incorporated herein by reference in its entirety.

BACKGROUND OF THE INVENTION

Radiant tubes are frequently used in natural gas burners or electrical heating elements, and are made of metal, ceramic or a combination thereof. Heat is passed through the tube to heat the load. Such radiant tubes have both industrial and household uses. In household uses, radiant tubes may be referred to as an heating elements and are found in numerous appliances.

A large variety of radiant tubes are used for industrial and commercial uses from heating facilities to incorporation in industrial processes. These radiant tubes may have a large variety of shapes and uses; however, they use the principals of radiant heat to transfer heat view infrared radiation. Radiant heat is transmitted by infrared radiation from a heat source, and not by conduction or convection.

Radiant tubes are used to better maintain a constant temperature. One type of conventional radiant tube heater has only a single tube. Another conventional radiant tube heater has in combination concentric inner and outer tubes. It is also known to bend or twist these embodiments to compact or concentrate the amount of heat provided by the radiant tube.

Two exemplary forms involve a straight radiant tube with either a reflector to reflect the heat as desired or at least one additional tube forming concentric tubes with spaces therebetween. For example, U.S. Pat. No. 6,971,871 discloses a radiant heater including a burner having an inlet for receiving an air and gas mixture and an exhaust for emitting exhaust gasses generated by combustion of the air and gas mixture within the burner with an elongated radiant heating tube having an inlet for receiving the exhaust by the burner. A reflector having a reverted U configuration in cross-section is suitably supported in spaced overlying relation and generally coextensive with the radiant tube. U.S. Pat. No. 4,979,491 shows a radiant tube and reflector hanger wherein the radiant tube is shown as a simple tube with opening therethrough and a shield disposed above the radiant tube directing the heat downward accordingly. U.S. Pat. No. 4,727,854 discloses a high efficiency infrared radiant energy heating system and a reflector therefor having an inner tube and an outer tube; the outer tube is closed at one end.

Similarly, U.S. Pat. No. 5,163,416 discloses a radiant tube arrangement for high temperature, industrial heat treat furnace in which the tube within a tube (or multiple configurations thereof) are used with the outer tube closed at the end opposite the source of heat fuel-fired ceramic heat tubes. U.S. Pat. No. 5,127,826 teaches a single ended radiant tube for furnace heating that has four concentric tubes. Fuel gas is fed through an inner tube with combustion air flowing through the space between tubes. The outer tube is closed at the end opposite the source of gases. U.S. Pat. No. 4,479,535 describes a recuperative radiant tube of the closed ended outer tube type.

Another example of the closed end outer tube is found in U.S. Pat. No. 5,016,610 which discloses a radiant tube type heater having inner and outer concentric tubes the inner tube delivering ignite fuel while the outer tube provides space for combustion gas (air) and has a closed end opposite the source of fuel. The tubes used therein have a structure in which silicon carbide particles are joined to each other by a sintering aid such as an aluminum compound sintering aid or a boron compound sintering aid.

Conversely, U.S. Pat. No. 5,224,542 discloses a gas fired radiant tube heater uses a gas fired burner which fires heated products of combustion into an inner longitudinally-extending tube that is concentrically pinned to an outer longitudinally-extending tube which is concentrically mounted within a heat transfer tube which radiates the heat to work. U.S. Pat. No. 4,800,866 teaches a low nitrous oxide radiant tube burner involving tubes within tubes. U.S. Pat. No. 6,321,743 shows a single-ended self-recuperated radiant tube annulus system. U.S. Pat. No. 5,224,857 shows a radiant tube arrangement for high temperature, industrial heat treat furnace in which the outer tube is closed off at one end thereof.

Examples of novel uses of radiant tubes include U.S. Pat. No. 6,489,553 which shows an at home cogeneration generator utilizing a gas heated radiant tube, U.S. Pat. No. 6,769,909 which shows a paint baking oven with radiant tube heating elements associated reflectors, U.S. Pat. No. 5,981,920 which shows a furnace for heating glass sheets uses electrical coils to heat the inside of parallel burner tubes, and U.S. Pat. No. 3,663,798 which shows a stove top having radiant tube heating elements disposed beneath a flat surface in which the tubes have a heating element and shield disposed within them so that the radiant tube heats primarily on the top side opposite the shield. Examples of household uses include U.S. Pat. No. 5,626,125 shows a space heating apparatus which includes a radiant tube bent back on itself forming parallel legs and shielding to direct the heat as desired disposed above each leg and a second type of shield disposed above both legs and shielding to direct the heat as desired.

Various shapes of radiant tubes are also known. The most common is probably the U-shaped configuration in which the radiant tubes foam legs and curves forming a U-shape. U.S. Pat. No. 4,673,350 shows such a radiant tube wherein the tube is bent back upon itself; however, no shield or outer tube is shown therein. U.S. Pat. No. 6,027,333 shows a U-shaped radiant tube burner.

Some radiant tubes, especially those which are heated by the combustion of air and gaseous hydrocarbon fuels may have a catalyst disposed within the radiant tube to regulate combustion. U.S. Pat. No. 5,992,409 teaches a catalytic radiant tube heater and method for its use having a catalyst tube disposed within the radiant tube. A tube having openings spaced throughout is disposed within the catalytic tube to deliver hydrocarbon fuels throughout the catalytic tube. The combustion of these hydrocarbons heats the catalytic tube which in turn heats the radiant tube. The preferred catalyst is cobalt chromium oxide spinel. A reflector is used in this design to direct the radiation in the desired direction.

Alternative cross sections of radiant tubes are also known. Such alternative cross sections may include a variety of configurations designed to produce eddies within the turbulent flow of air and/or gaseous fuel to facilitate a desired mixture thereof. Various openings and inlets may be provided at the open ends of the tubes to introduce different air and/or gaseous fuels from different openings and/or to produce a desirable mixture of combustion gases and fuels. It is also known to have inlets and openings for air and gaseous fuel to be introduced or exhausted. Furthermore, although the outer tube tends to be a single piece, the inner tube may be different tubes either concentrically included therein or lined up end to end within the outer tube. Fans and other devices to control or mix the flow of air and fuel are also used in conventional radiant tube applications and may be provided within the outer tube structure and at either the input or output of gaseous fuel and air.

It is conventional to use mounting devices to hold the radiant tube in place relative to the shield, or where appropriate, to additional concentric tubes, or both. Spacers may be used to hold the radiant tubes in place relative other concentric tubes to maintain proper relative spacing therebetween.

SUMMARY OF THE INVENTION

The present invention relates to a radiant tube assembly (12) having at least one tubular structure (14, 16, 22, and 24), including an inner tubular structure (14) having a heat source (30) distributing heat therethrough. Each tubular structure (14, 16, 22, or 24), has an exterior side (15) and a heat source (30) to deliver heat to the interior of the tubular structure (14) and for communicating heat to the exterior side (15) thereof through radiant heat. A thermal protective layer (18) is disposed upon at least one exterior side (15) of the tubular structure (14, 16, 22, and 24). An outer tubular structure (16) may be present. A thermal protective layer (18) may be disposed on the outer tubular structure's (16) interior side (17) and/or exterior side (15).

A thermal protective layer (18) on at least one exposed metallic/alloy surface of a radiant tube (14, 16, 22, or 24) according to an embodiment of the present invention may contain from about 5% to about 40% of an inorganic adhesive, from about 45% to about 92% of a filler, and from about 1% to about 20% of one or more emissivity agents. An alternative thermal protective layer on at least one exposed ceramic surface of a radiant tube according to another embodiment of the present invention may contain from about 5% to about 60% of colloidal silica, colloidal alumina, or combinations thereof, from about 23% to about 79% of a filler, and from about 1% to about 20% of one or more emissivity agents. A thermal protective layer 18 of the present invention may further contain from about 1% to about 5% of a stabilizer. A surfactant or colorant may also be present therein.

An aspect of the present invention is that the thermal protective layer (18) may lead to increased heat transfer.

Another aspect of the present invention is the longer life for radiant heat tubes (14, 16, 22, or 24) because the addition of a thermal protective layer (18) increases both corrosion and erosion resistance.

Furthermore, another aspect of the present invention is that it provides for more even heating resulting in less warping due to hotspots.

Also, the present invention permits product redesign to allow the manufacture of tubes for less cost. For example, a shorter tube may provide the same radiant heat but uses less raw materials for same output.

Product redesign may allow increased product capability. The thermal protective layer (18) permits far greater range of heat to be used than possible with the uncoated materials.

Also a larger burner may be used that may result in more heat output which is currently impossible due to current substrate constraints.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

Similar reference characters denote corresponding features consistently throughout the attached drawings.

DETAILED DESCRIPTION OF PREFERRED EMBODIMENTS

Figure 1A:
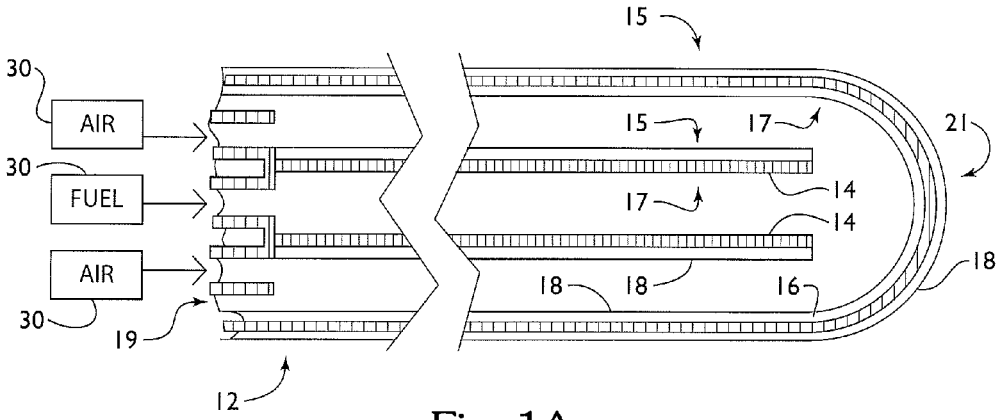
FIG. 1A shows a cross sectional side view of an embodiment of a radiant tube assembly (12) according to an embodiment of the present invention wherein a thermal protective layer (18) is disposed on the exterior side of an inner tubular structure (14) and on both the interior and exterior sides (17 and 15) of a close ended (21) outer tubular structure (16).
Figure 1B:
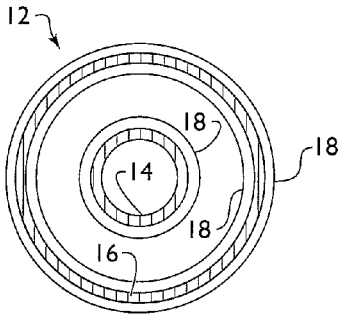
FIG. 1B shows a cross sectional view of the embodiment depicted in FIG. 1A.

The present invention relates to a radiant tube assembly (12), as shown in FIGS. 1A and 1B, having at least one tubular structure (14, 16, 22, and 24), including an inner tubular structure (14) having a heat source (30) distributing heat therethrough. Each tubular structure having an exterior side (15), and a heat source (30) for delivering heat to the interior of the tubular structure (14) and for communicating heat to the exterior side (15) thereof through radiant heat. A thermal protective layer (18) is disposed upon at least one exterior side (15) thereof. Air is permitted to contact the exterior side (15) of the inner tubular structure (14).

Figure 2A:
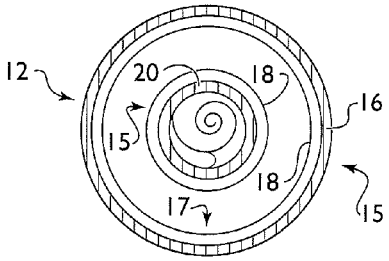
FIG. 2A shows a cross sectional side view of another embodiment of a radiant tube assembly (12) according to the present invention wherein a thermal protective layer (18) is disposed on the exterior side (15) of an electrically heated (30) with an electrical coil (20) disposed within the inner tube (14), which in turn extends into a close ended (21) outer tubular structure (16) in which a thermal protective layer (18) is disposed on the interior surface (17) of the outer tubular structure (16).
Figure 2B:
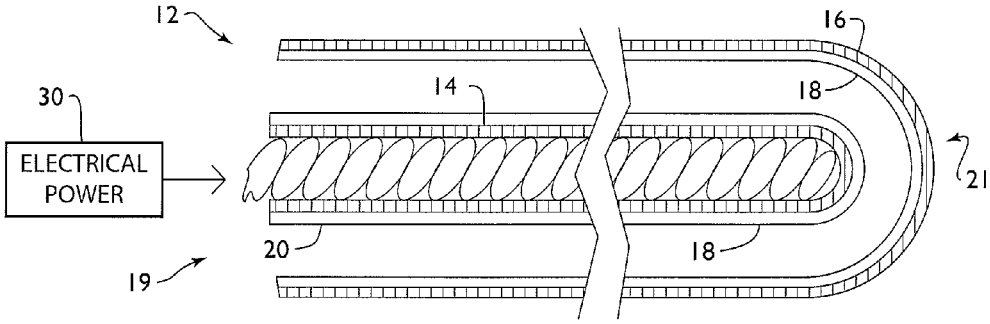
FIG. 2B is a cross sectional view of the embodiment depicted in FIG. 2A.

The heat source (30) may be a mixture of gaseous fuel, such as a hydrocarbon gas, and combustible gas, such as air. Alternatively, the heat source (30) may be an electrical coil (20) as shown in FIGS. 2A and 2B. In either case, the inner tubular structure (14) emits radiant heat communicated therethrough by the heat source (30) to form a predominantly uniform distribution of heat emitted from the inner tubular structure (14).

Figure 3A:
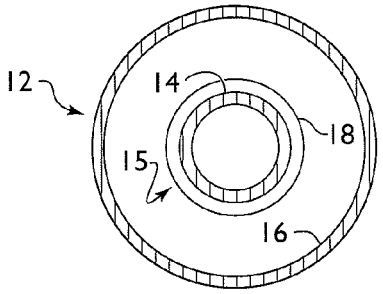
FIG. 3A is a cross sectional view of yet another embodiment of the present invention wherein only the inner tube (14) through which the heat originates has a thermal protective layer (18) disposed thereon.
Figure 3B:
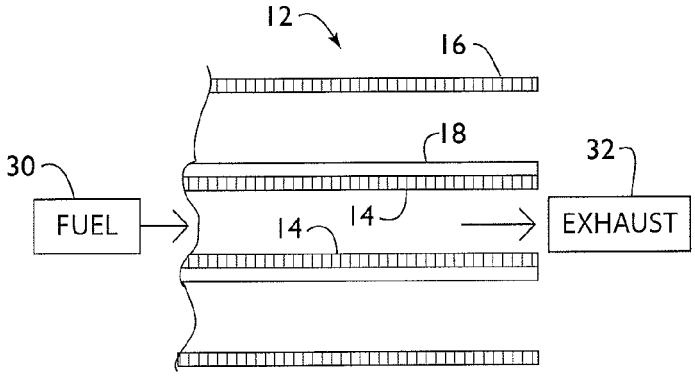
FIG. 3B is a side cutaway view of a radiant tube assembly (12) according to the embodiment depicted in FIG. 3A, in which the outer tube (16) is open and heating gas is exhausted therethrough.

An outer tubular structure (16) may encompass the inner tubular structure (14), as shown in FIG. 1A. The outer tubular structure (16) has an interior (17) and an exterior (15) sides. Air is permitted to circulate between the outer and inner tubular structures (16 and 14). The outer tubular structure (16) has an open end (19) and a closed end (21) as shown in FIGS. 1A, 2A, 7 and 8. FIG. 3B shows an alternative embodiment wherein an exhaust (32) is provided opposite the heat source (30) permitting heated air to be communicated through the outer tubular structure (16).

Figure 4:
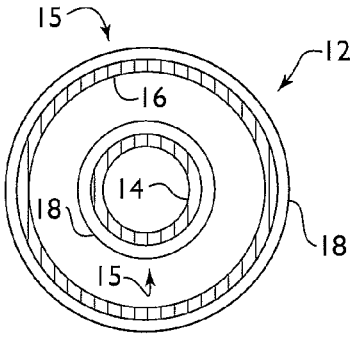
FIG. 4 is a cross sectional view of an embodiment of the present invention in which the inner tube (14) is coated in a thermal protective layer (18) and the outer tube's (16) exterior (15) is also coated with a thermal protective layer (18).
Figure 5:
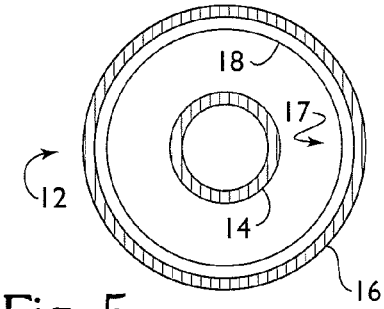
FIG. 5 is a cross sectional view of an embodiment of the present invention is which an inner tube (14) is present but a thermal protective layer (18) is disposed on the interior (17) of the outer tubular structure (16).
Figure 6:
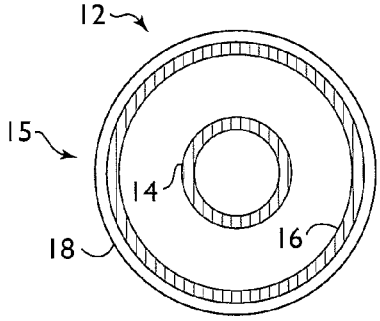
FIG. 6 is a cross sectional view of an embodiment of the present invention is which an inner tube (14) is present but a thermal protective layer (18) is disposed on the exterior (15) of the outer tubular structure (16).

A thermal protective layer (18) is disposed on the exterior sides (15) of the inner and outer tubular structures (14 and 16), and on the interior side (17) of the outer tubular structure (16), as shown in FIGS. 1A and 1B. In FIGS. 2A and 2B, the thermal protective layer (18) is disposed on the exterior surface (15) of the inner tubular structure (14) which has an electrical coil (20) to heat it, and also on the interior surface (17) of the outer tubular structure (16). The thermal protective layer (18), in FIGS. 3A and 3B, is disposed only on the exterior side (15) of the inner tubular structure (14). FIG. 4 shows the protective layer (18) on the exterior sides (15) of both the inner and outer tubular structures (14 and 16). FIG. 5 shows the protective layer (18) solely on the interior side (17) of the outer tubular structure (16). FIG. 6 shows the protective layer (18) solely on the exterior surface (15) of the outer tubular structure (16).

Figure 7:
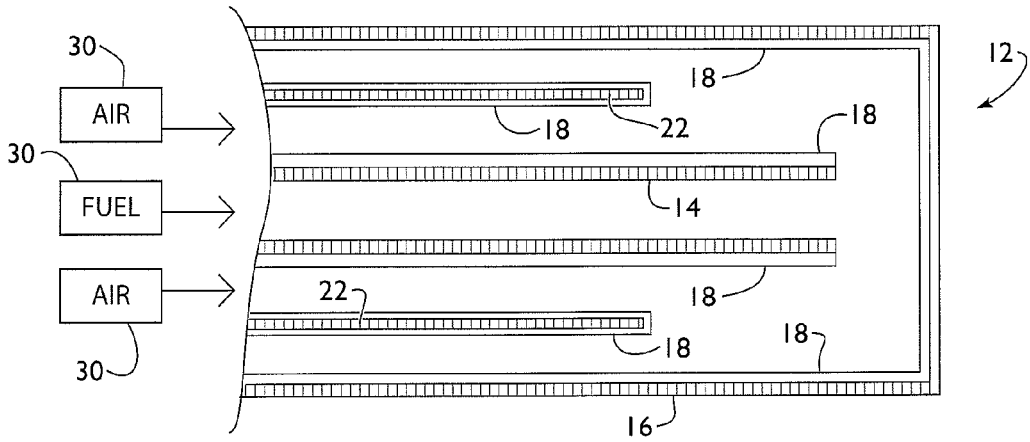
FIG. 7 is a cutaway side view of a radiant tube assembly (12) according to an embodiment of the present invention wherein an additional tube (22) is present between the inner and outer tubular structures (14 and 16).
Figure 8:
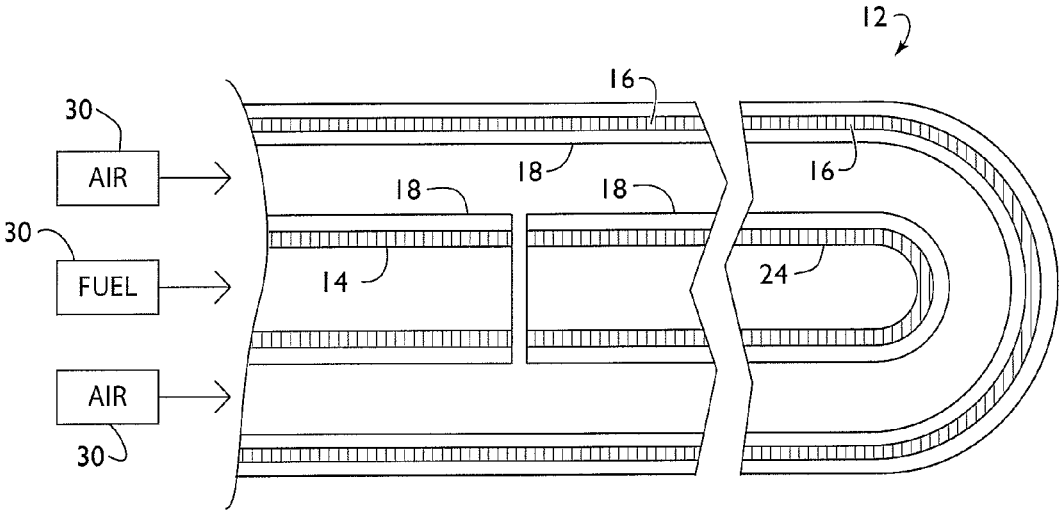
FIG. 8 is a cutaway side view of a radiant tube assembly (12) according to another embodiment of the present invention wherein two inner tubes (14 and 24) are shown abutted against one another within the length of the outer tube (16).
Figure 9:
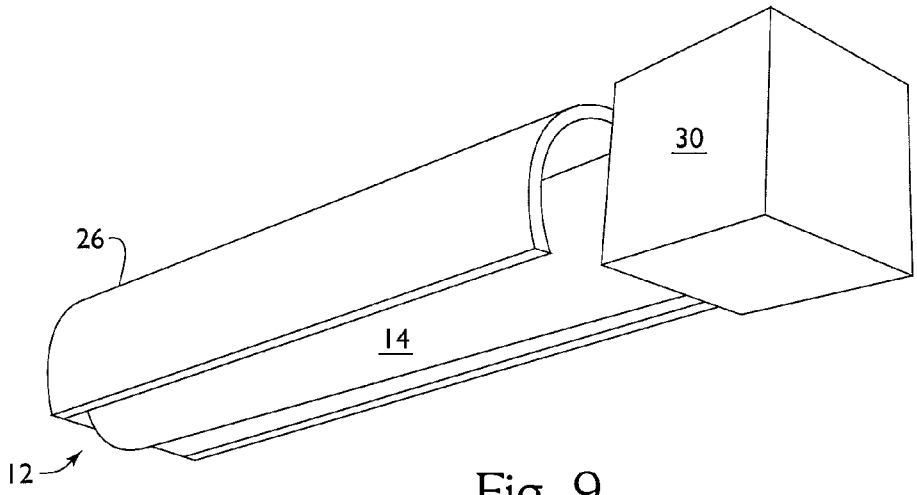
FIG. 9 is an environmental perspective view of a radiant tube assembly (12) and reflector assembly (26) according to yet another embodiment of the present invention.

FIGS. 7 and 8 show alternative embodiments of the radiant tube assembly (12) according to the present invention. FIG. 7 has a close ended outer tubular structure (16) and a third tubular structure (22) disposed between the inner and outer tubular structures (14 and 16) permitting flow of air between all three tubular structures (14, 16, and 22). Extra tubular structures may be distributed between the inner and outer tubular structures (14 and 16) in order to mix more air or combustible gases or otherwise control the heat distributed therefrom.

FIG. 8 has a closed ended outer tubular structure (16) with multiple inner tubular structures (14 and 24) lined up end to end therein. Such embodiments may be useful where differing thermal properties are desired in the inner tubular structures (14 and 24). Various thermal foot prints are desired depending on the use of the radiant tube assembly (12) of the present invention. Some applications utilize extreme radiant temperatures whereas others utilize household ambient temperatures as desired during winter, for example. Various well known configurations of tubular structures are used to create different radiant heat for a large variety of uses.

Figure 10:
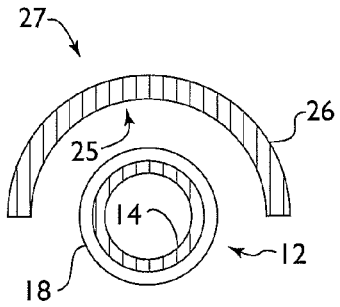
FIG. 10 is a cross sectional view of a reflector (26) and radiant tube assembly (12) wherein the radiant tube (14) has a thermal protective layer (18) disposed on an exterior surface (15) thereon.
Figure 11:
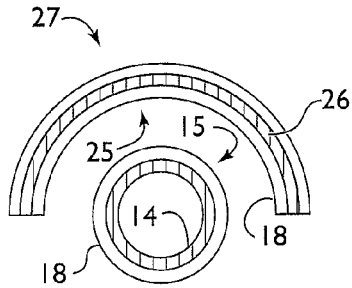
FIG. 11 is a cross sectional view of a reflector (26) and radiant tube assembly (12) wherein the radiant tube (14) has a thermal protective layer (18) disposed on an exterior surface (15) thereon and on the interior and exterior sides (25 and 27) of the reflector (26) as well.
Figure 12:
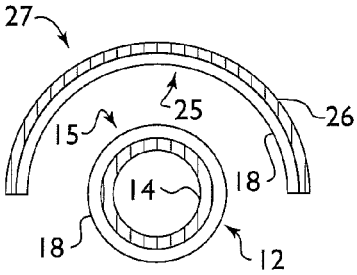
FIG. 12 is a cross sectional view of a reflector (26) and radiant tube assembly (12) wherein the radiant tube (14) has a thermal protective layer (18) disposed on an exterior surface (15) thereon and on the interior side (25) of the reflector (26).
Figure 13:
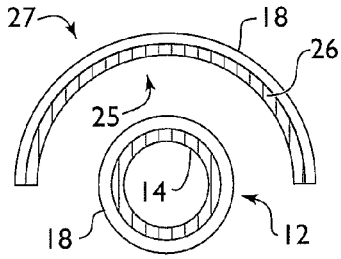
FIG. 13 is a cross sectional view of a reflector (26) and radiant tube assembly (12) wherein the radiant tube (14) has a thermal protective layer (18) disposed on an exterior surface (15) thereon and on the exterior side (27) of the reflector (26).

Another embodiment of the present invention which utilizes at least one tubular structure (14) is shown in FIGS. 9 through 13. A reflector (26) which has an interior side (25) and an exterior side (27) wherein the interior side (25) reflects the radiant heat in a desired direction. The thermal protective layer (18) is disposed upon the exterior surface (15) of the tubular structure (14) shown in each of the FIGS. 9 through 13. In FIG. 10 the reflector (26) does not have a thermal protective layer disposed thereon. FIG. 11 has a thermal protective layer (18) disposed on both the interior and exterior sides (25 and 27) thereof. FIG. 12 has the thermal protective layer (18) disposed on the interior surface (25), while FIG. 13 has the thermal protective layer (18) disposed on the exterior surface (27). The determination of where the thermal protective layer (18) should be placed is governed by the desired thermal footprint. Furthermore, although the embodiments of a radiant tube assembly (12) having a reflector (26) therewith, as shown in the FIGS. 9 through 13, show only one radiant tubular structure (14) with an associated reflector (26), the present invention is not limited to such an embodiment. A reflector (26) may be used with any of various embodiments of the present invention. Furthermore, a reflector designed to reflect heat from only a part of the radiant tube are well known and are included herein.

The present invention is described by way of straight radiant tubes as examples for ease of understanding. It is to be understood that any configuration of radiant tube may be substituted for straight radiant tubes. Also, the cross sectional configuration of the tubular structures need not be round, as shown herein, but may be of a variety of shapes and patterns. Such patterns and alternative shapes may be utilized to create eddies or particular combustion gas flow patterns or other impact on the radiant heat footprint of the radiant tube assembly (12). Furthermore, the present invention is not limited to the tube within a tube configuration described herein but also includes analogous structures wherein radiant tubes are enclosed within functionally similar although not tubular structures.

The thermal protective layer (18) may be applied as a high emissivity thermal protective coating. Suitable coatings and methods of application are described in U.S. Pat. Nos. 7,105,047 and 6,921,431 and assigned to Wessex Incorporated, the contents of which are incorporated herein in their entirety.

A high emissivity coating suitable for forming a thermal protective layer (18) on a (metal) radiant tube assembly (12) of the present invention may contain from about 5% to about 40% of an inorganic adhesive, from about 45% to about 92% of a filler, and from about 1% to about 20% of one or more emissivity agents, in a dry admixture. Preferably, the dry admixture also contains from about 1% to about 5% of a stabilizer. A surfactant and/or colorant may also be present.

An alternative high emissivity coating suitable for forming a thermal protective layer (18) on a (ceramic) radiant tube assembly (12) according to an embodiment of the present invention may contain from about 5% to about 60% of colloidal silica, colloidal alumina, or combinations thereof, from about 23% to about 79% of a filler, from about 1% to about 20% of one or more emissivity agents. Preferably, a thermal protective layer (18) of the present invention also contains from about 1% to about 5% of a stabilizer. A surfactant and/or colorant may also be present.

As used herein, all percentages (%) are percent weight-to-weight, also expressed as weight/weight %, % (w/w), w/w, w/w % or simply %, unless otherwise indicated. Also, as used herein, the terms "wet admixture" refers to relative percentages of the composition of the thermal protective coating in solution and "dry admixture" refers to the relative percentages of the composition of the dry thermal protective coating mixture prior to the addition of water. In other words, the dry admixture percentages are those present without taking water into account. Wet admixture refers to the admixture in solution (with water). "Wet weight percentage" is the weight in a wet admixture, and "dry weight percentage" is the weight in a dry admixture without regard to the wet weight percentages. The term "total solids", as used herein, refers to the total sum of the silica/alumina and the alkali or ammonia ($NH_3$), plus the fraction of all solids including impurities. Weight of the solid component divided by the total mass of the entire solution, times one hundred, yields the percentage of "total solids".

Method of preparation of coating involves applying a wet admixture of the coating to the surface to be coated. Alternative methods may include spraying the wet admixture on the surface or atomizing the dry admixture and coating the surface accordingly.

In a coating solution, used for a protective layer (18), according to an embodiment of the present invention, a wet admixture of the thermal protective coating contains from about 6% to about 40% of an inorganic adhesive, from about 23% to about 56% of a filler, from about 0.5% to about 15% of one or more emissivity agents, and from about 18% to about 50% water. In order to extend the shelf life of the coating solution, from about 0.5% to about 2.5% of a stabilizer is preferably added to the wet admixture. Up to about 1.0% of a surfactant may be added. The wet admixture coating solution contains between about 40% and about 60% total solids.

In a coating solution according to the present invention, a wet admixture of the alternative thermal protective coating contains from about 15% to about 60% of colloidal silica, colloidal alumina, or combinations thereof, from about 23% to about 55% of a filler, from about 0.5% to about 15% of one or more emissivity agents, from about 0.5% to about 2.5% of a stabilizer and from about 10% to about 40% water. The wet admixture coating solution contains between about 40% and about 70% total solids.

The inorganic adhesive is preferably an alkali/alkaline earth metal silicate taken from the group consisting of sodium silicate, potassium silicate, calcium silicate, and magnesium silicate. The colloidal silica is preferably a mono-dispersed distribution of colloidal silica, and therefore, has a very narrow range of particle sizes. The filler is preferably a metal oxide taken from the group consisting of silicon dioxide, aluminum oxide, titanium dioxide, magnesium oxide, calcium oxide and boron oxide. The emissivity agent(s) is preferably taken from the group consisting of carbon tetraboride, silicon tetraboride, silicon hexaboride, silicon carbide, molybdenum disilicide, tungsten disilicide, zirconium diboride, cupric chromite, and metallic oxides such as iron oxides, magnesium oxides, manganese oxides, copper chromium oxides, and chromium oxides, cerium oxides, and terbium oxides, and derivatives thereof. The copper chromium oxide, as used in the present invention, is a mixture of cupric chromite and cupric oxide. The stabilizer may be taken from the group consisting of bentonite, kaolin, magnesium alumina silica clay, tabular alumina and stabilized zirconium oxide. The stabilizer is preferably bentonite. Other ball clay stabilizers may be substituted herein as a stabilizer. Colloidal alumina, in addition to or instead of colloidal silica, may also be included in the admixture of the present invention. When colloidal alumina and colloidal silica are mixed together one or the other requires surface modification to facilitate mixing, as is known in the art.

Coloring may be added to the protective coating layer (18) of the present invention to depart coloring to the tubes. Inorganic pigments may be added to the protective coating without generating toxic fumes. In general, inorganic pigments are divided into the subclasses: colored (salts and oxides), blacks, white and metallic. Suitable inorganic pigments include but are not limited to yellow cadmium, orange cadmium, red cadmium, deep orange cadmium, orange cadmium lithopone and red cadmium lithopone.

A preferred embodiment of the protective layer (18) according to an embodiment of the present invention contains a dry admixture of from about 10% to about 30% sodium silicate, from about 50% to about 79% silicon dioxide powder, and from about 2% to about 20% of one or more emittance agent(s) taken from the group consisting of iron oxide, boron silicide, boron carbide, silicon tetraboride, silicon carbide, molybdenum disilicide, tungsten disilicide, zirconium diboride. Preferred embodiments of the thermal coating may contain from about 1.0% to about 5.0% bentonite powder in dry admixture.

The corresponding coating in solution (wet admixture) for this embodiment contains from about 10.0% to about 35.0% sodium silicate, from about 25.0% to about 46.0% silicon dioxide, from about 18.0% to about 39.0% water, and from about 1.0% to about 8.5% one or more emittance agent(s). This wet admixture must be used immediately. In order to provide a coating solution admixture (wet admixture), which may be stored and used later, preferred embodiments of the thermal coating contain from about 0.25% to about 2.50% bentonite powder. Preferably deionized water is used. Preferred embodiments of the wet admixture have a total solids content ranging from about 45% to about 55%.

A preferred thermal protective coating for the present invention contains a dry admixture from about 15.0% to about 30.0% sodium silicate, from about 69.0% to about 79.0% silicon dioxide powder, about 1.00% bentonite powder, and from about 5.00% to about 15.0% of an emittance agent. The emittance agent is taken from one or more of the following: iron oxide, boron silicide, and boron carbide.

A most preferred wet admixture contains about 20.0% sodium silicate based on a sodium silicate solids content of about 37.45%, from about 34.5% to about 39.5% silicon dioxide powder, about 0.500% bentonite powder, and from about 2.50% to about 7.5% of an emittance agent, with the balance being water. The emittance agent is most preferably taken from the group consisting of iron oxide, boron silicide, and boron carbide (also known as, carbon tetraboride). Preferred embodiments include those where the emittance agent comprises about 2.50% iron oxide, from about 2.50% to about 7.50% boron silicide, or from about 2.50% to about 7.50% boron carbide.

A preferred embodiment of the present invention contains a dry admixture of from about 10.0% to about 35.0% colloidal silica, from about 50% to about 79% silicon dioxide powder, and from about 2% to about 15% of one or more emittance agent(s) taken from the group consisting of cerium oxide, boron silicide, boron carbide, silicon tetraboride, silicon carbide molybdenum disilicide, tungsten disilicide, zirconium diboride, and from about 1.5% to about 5.0% bentonite powder.

The corresponding coating in solution (wet admixture) for this embodiment contains from about 20.0% to about 35.0% colloidal silica, from about 25.0% to about 55.0% silicon dioxide, from about 18.0% to about 35.0% water, and from about 2.0% to about 7.5% one or more emittance agent(s), and from about 0.50% to about 2.50% bentonite powder. Preferably deionized water is used. Preferred embodiments of the wet admixture have a total solids content ranging from about 50% to about 65%.

A most preferred thermal protective coating of the present invention contains a dry admixture from about 15.0% to about 35.0% colloidal silica, from about 68.0% to about 78.0% silicon dioxide powder, about 2.00% to about 4.00% bentonite powder, and from about 4.00% to about 6.00% of an emittance agent. The emittance agent is taken from one or more of the following: zirconium boride, boron silicide, and boron carbide.

A most preferred wet admixture contains about 27.0% colloidal silica based on a colloidal silica solids content of about 40%, from about 25% to about 50% silicon dioxide powder, about 1.50% bentonite powder, and from about 2.50% to about 5.50% of an emittance agent, with the balance being water. The emittance agent is most preferably taken from the group consisting of zirconium boride, boron silicide, and boron carbide. Preferred embodiments include those where the emittance agent comprises about 2.50% zirconium diboride, about 2.50% boron silicide, or from about 2.50% to about 7.50% boron carbide. The pH of a most preferred wet admixture according to the present invention is about 9.0.+–.1.0, the specific gravity is about 1.40 to 1.50 and the total solids content is about 50% to 60%.

An inorganic adhesive, which may be used in the present invention, includes N (trademark) type sodium silicate that is available from the PQ Corporation (of Valley Forge, Pa.). Sodium silicate, also known as waterglass, is a versatile, inorganic chemical made by combining various ratios of sand and soda ash (sodium carbonate) at high temperature. Sodium silicates ($Na_2O.XSiO_2$) are metal oxides of silica. All soluble silicates can be differentiated by their ratio, defined as the weight proportion of silica to alkali ($SiO_2/Na_2O$). Ratio determines the physical and chemical properties of the coating. The glassy nature of silicates imparts strong and rigid physical properties to dried films or coatings. Silicates air dry to a specific moisture level, according to ambient temperature and relative humidity. Heating is necessary to take these films to complete dryness—a condition in which silicates become nearly insoluble. Reaction with other materials, such as aluminum or calcium compounds, will make the film coating completely insoluble. The N (trademark) type sodium silicate, as used in the examples below, has a weight ratio $SiO_2/Na_2O$ is 3.22, 8.9% $Na_2O$, 28.7% $SiO_2$, with a density (at room temperature of 20° C.) of 41.0° Be', 11.6 lb/gal or 1.38 g/cm.sup.3. The pH is 11.3 with a viscosity of 180 centipoises. The N type sodium silicate is in a state of a syrupy liquid.

The term "total solids" refers to the sum of the silica and the alkali. The weight ratio is a most important silicate variable. Ratio determines the product solubility, reactivity and physical properties. Ratio is either the weight or molar proportion of silica to alkali. Density is an expression of total solids and is typically determined using a hydrometer. As temperatures increase, density decreases. When solids content increases, density increases. The pH is a function of silicate composition and solids concentration. The pH value of silicates does not truly reflect the alkali content of solution, due to the strong buffering capability of silica. This means the pH of a silicate solution is kept constant until almost completely neutralized. The buffering capacity of silicate solutions increases with increasing ratio of silica to alkali.

Ludox (trademark) colloidal silica is available from Grace Davidson (of Columbia, Md.). The particles in Ludox (trademark) colloidal silica are discrete uniform spheres of silica which have no internal surface area or detectable crystallinity. Most are dispersed in an alkaline medium which reacts with the silica surface to produce a negative charge. Because of the negative charge, the particles repel one another resulting in stable products. Although most grades are stable between pH 8.5-11.0, some grades are stable in the neutral pH range. Ludox (trademark) colloidal silicas are aqueous colloidal dispersions of very small silica particles. They are opalescent to milky white liquids. Because of their colloidal nature, particles of Ludox (trademark) colloidal silica have a large specific surface area which accounts for the novel properties and wide variety of uses. Ludox (trademark) colloidal silica is available in two primary families: mono-dispersed, very narrow particle size distribution of Ludox (trademark) colloidal silica and poly-dispersed, broad particle size distribution of Ludox (trademark) P. The Ludox (trademark) colloidal silica is converted to a dry solid, usually by gelation. The colloidal silica can be gelled by (1) removing water, (2) changing pH, or (3) adding a salt or water-miscible organic solvent. During drying, the hydroxyl groups on the surface of the particles condense by splitting out water to form siloxane bonds (Si—O—Si) resulting in coalescence and interbonding. Dried particles of Ludox (trademark) colloidal silica are chemically inert and heat resistant. The particles develop strong adhesive and cohesive bonds and are effective binders for all types of granular and fibrous materials, especially when use at elevated temperature is required.

Colloidal alumina is available as Nyacol (trademark) colloidal alumina available from Nyacol Nano Technologies, Inc. (Ashland, Mass.), and is available in deionized water to reduce the sodium and chlorine levels to less than 10 ppm. Nyacol may contain about 20 percent by weight of $AL_2O_3$, a particle size of 50 nm, positive particle charge, pH 4.0, specific gravity of 1.19, and a viscosity of 10 cPs.

The filler may be a silicon dioxide powder such as Min-U-Sil (trademark) silicon dioxide available from U.S. Silica (of Berkeley Springs, W. Va.). This silicon dioxide is fine ground silica. Chemical analysis of the Min-U-Sil (trademark) silicon dioxide indicates contents of 98.5% silicon dioxide, 0.060% iron oxide, 1.1% aluminum oxide, 0.02% titanium dioxide, 0.04% calcium oxide, 0.03% magnesium oxide, 0.03% sodium dioxide, 0.03% potassium oxide and a 0.4% loss on ignition. The typical physical properties are a compacted bulk density of 41 lbs/ft.sup.3, an uncompacted bulk density of 36 lbs/ft.sup.3, a hardness of 7 Mohs, hegman of 7.5, median diameter of 1.7 microns, an oil absorption (D-1483) of 44, a pH of 6.2, 97%-5 microns, 0.005%+325 Mesh, a reflectance of 92%, a 4.2 yellowness index and a specific gravity of 2.65.

Emittance agents are available from several sources. Emissivity is the relative power of a surface to emit heat by radiation, and the ratio of the radiant energy emitted by a surface to the radiant energy emitted by a blackbody at the same temperature. Emittance is the energy radiated by the surface of a body per unit area.

The boron carbide, also known as carbon tetraboride, which may be used as an emissivity agent in the present invention, is available from Electro Abrasives (of Buffalo, N.Y.). Boron Carbide is one of the hardest man made materials available. Above 1300° C., it is even harder than diamond and cubic boron nitride. It has a four point flexural strength of 50,000 to 70,000 psi and a compressive strength of 414,000 psi, depending on density. Boron Carbide also has a low thermal conductivity (29 to 67 W/mK) and has electrical resistivity ranging from 0.1 to 10 ohm-cm. Typical chemical analysis indicates 77.5% boron, 21.5% carbon, iron 0.2% and total Boron plus Carbon is 98%. The hardness is 2800 Knoop and 9.6 Mohs, the melting point is 4262° F. (2350° C.), the oxidation temperature is 932° F. (500° C.), and the specific gravity is 2.52 g/cc.

Green silicon carbide (SiC), an optional emissivity agent, is also available from Electro Abrasives. Green Silicon Carbide is an extremely hard (Knoop 2600 or Mohs 9.4) man made mineral that possesses high thermal conductivity (100 W/m-K). It also has high strength at elevated temperatures (at 1100° C., Green SiC is 7.5 times stronger than $Al_2O_3$). Green SiC has a Modulus of Elasticity of 410 GPa, with no decrease in strength up to 1600° C., and it does not melt at normal pressures but instead dissociates at 2815.5° C. Green silicon carbide is a batch composition made from silica sand and coke, and is extremely pure. The physical properties are as follows for green silicon carbide: the hardness is 2600 Knoop and 9.4 Mohs, the melting point is 4712° F. (2600° C.), and the specific gravity is 3.2 g/cc. The typical chemical analysis is 99.5% SiC, 0.2% $SiO_2$, 0.03% total Si, 0.04% total Fe, and 0.1% total C. Commercial silicon carbide and molybdenum disilicide may need to be cleaned, as is well known in the art, to eliminate flammable gas generated during production.

Boron silicide ($B_6Si$) is available from Cerac (of Milwaukee, Wis.). The boron silicide, also known as silicon hexaboride, available from Cerac has a −200 mesh (about 2 microns average) and a typical purity of about 98%. Zirconium boride ($ZrB_2$) (Item# Z-1031) is also available from Cerac with a typical average of 10 microns or less (−325 mesh), and a typical purity of about 99.5%. Iron oxide available from Hoover Color (of Hiwassee, Va.) is a synthetic black iron oxide ($Fe_2O_3$) which has an iron oxide content of 60%, a specific gravity of 4.8 gm/cc, a tap density (also known as, bulk density) of 1.3 gm/cc, oil absorption of 15 lbs/100 lbs, a 325 mesh residue of 0.005, and a pH ranging from 7 to 10.

Iron oxide available from Hoover Color (of Hiwassee, Va.) is a synthetic black iron oxide ($Fe_2O_3$) which has an iron oxide content of 60%, a specific gravity of 4.8 gm/cc, a tap density (also known as, bulk density) of 1.3 gm/cc, oil absorption of 15 lbs/100 lbs, a 325 mesh residue of 0.005, and a pH ranging from 7 to 10.

The admixture may include bentonite powder, tabular alumina, or magnesium alumina silica clay. The bentonite powder permits the coating to be prepared and used at a later date. Otherwise, the coating must be applied to the support layer as soon as mixed. The examples provided for the present invention include PolarGel bentonite powder available from Mineral and Pigment Solutions, Inc. (of South Plainfield, N.J.). Bentonite is generally used for the purpose of suspending, emulsifying and binding agents, and as rheological modifiers. The typical chemical analysis is 59.00% to 61.00% of silicon dioxide ($SiO_2$), 20.00% to 22.00% of aluminum oxide ($Al_2O_3$), 2.00% to 3.00% calcium oxide (CaO), 3.50% to 4.30% magnesium oxide (MgO), 0.60% to 0.70% ferric oxide ($Fe_2O_3$), 3.50% to 4.00% sodium oxide ($Na_2O$), 0.02% to 0.03% potassium oxide ($K_2O$), and 0.10% to 0.20% titanium dioxide and a maximum of 8.0% moisture. The pH value ranges from 9.5 to 10.5. Typical physical properties are 83.0 to 87.0 dry brightness, 2.50 to 2.60 specific gravity, 20.82 pounds/solid gallon, 0.0480 gallons for one pound bulk, 24 ml minimum swelling power, maximum 2 ml gel formation, and 100.00% thru 200 mesh. Tabular alumina and magnesium alumina silica clay are also available from Mineral and Pigment Solutions, Inc.

Colorants, which may be added to the present invention, include but are not limited to inorganic pigments. Suitable inorganic pigments, such as yellow iron oxide, chromium oxide green, red iron oxide, black iron oxide, titanium dioxide, are available from Hoover Color Corporation. Additional suitable inorganic pigments, such as copper chromite black spinel, chromium green-black hematite, nickel antimony titanium yellow rutile, manganese antimony titanium buff rutile, and cobalt chromite blue-green spinel, are available from The Shepherd Color Company (of Cincinnati, Ohio).

A surfactant may be added to the wet admixture prior to applying the thermal protective layer 18 to the radiant tube. The surfactant was Surfynol (trademark) available from Air Products and Chemicals, Inc. (of Allentown, Pa.). The Surfyonol (trademark) has a chemical structure of ethoxylated 2,4,7,9-tetramethyl 5 decyn-4,7-diol. Other surfactants may be used, such as STANDAPOL (trademark) T, INCI which has a chemical structure of triethanolamine lauryl sulfate, liquid mild primary surfactant available from Cognis-Care Chemicals (of Cincinnati, Ohio). The amount of surfactant present by weight in the wet admixture in from about 0.05% to about 0.2%.

The surface of the radiant tube (12) may be a metallic substrate such as iron, aluminum, alloys, steel, cast iron, stainless steel, and the like, or it may be a ceramic surface. Ceramic and metal/alloy surfaces of radiant tubes (12) are well known in the art. The coating is typically applied wet, and either allowed to air dry, heat dry, or dry upon facility start up.

The coating is typically applied directly to the support structure whether the external or internal surface of the radiant tube (12). The preparation of the support structure involves surface preparation, preparation of thermal protective coating, and application of the thermal protective coating to the surface of the support layer. First, preparation of the surface occurs. The surface is prepared first by grit basting and then cleaning the surface. Grit blasting is desirable to remove oxidation and other contaminants. Grit media should be chosen depending on metal type, and may include aluminum oxide, glass beads, black beauty, and the like. Alternative cleaning methods, such as very light grit blast, may be used for ceramic type tubes.

Gun pressure will vary depending on the cut type, condition of the metal and profile desired; very old metal requires 60-80 psi while newer metal may only require 40-60 psi. Oil free air should be used. The surface then cleaned after the grit blasting, the surface should be thoroughly cleaned to remove all loose particles with air blasts. Acetone can also be used on a clean cloth to wipe the surface clean. Acetone should be used under proper ventilation and exercising all necessary precautions. A cleaning compound may be used on certain stainless steel surfaces in lieu of grit blasting.

After the grit blast, the surface should be thoroughly cleaned to remove all loose particles with clean oil and water free air blasts. Avoid contaminating surface with fingerprints. Acetone can be used (under proper ventilation and exercising all necessary precautions when working with acetone) on a clean cloth to wipe the surface clean. A cleaning compound may be used on certain stainless steel in lieu of grit blasting. Dur-lum available from Blue Wave Ultrasonics (of Davenport, Iowa), a powdered alkaline cleaner, may be used in cleaning metal surface instead of, or in addition to, acetone.

When using the wet admixture containing a stabilizer, solids may settle during shipment or storage. Prior to use all previously mixed coating must be thoroughly re-mixed to ensure all settled solids and clumps are completely re-dispersed. When not using a stabilizer, the coating may not be stored for any period of time. In any case, the coating should be used immediately after mixing to minimize settling.

Mixing instructions for one and five gallon containers. High speed/high shear saw tooth dispersion blade 5" diameter for one gallon containers and 7" diameter for five gallon containers may be attached to a hand drill of sufficient power with a minimum no load speed of 2000 rpm shear. Dispersion blades can be purchased from numerous suppliers. Mix at high speed to ensure complete re-dispersion for a minimum of 30 minutes.

The product should be applied directly after cleaning a metal surface so minimal surface oxidation occurs. The product should be applied in a properly ventilated and well lit area, or protective equipment should be used appropriate to the environment. The mixed product should not be filtered or diluted.

A high volume low pressure (HVLP) spray gun should be used with 20-40 psi of clean, oil and water free air. Proper filters for removal of oil and water are required. Alternatively, an airless spray gun may be used, especially but not exclusively, for ceramic substrate applications. Other types of spray equipment may be suitable. The applicator should practice spraying on scrap metal prior to spraying the actual part to ensure proper coverage density. An airless spray system is preferable for applications on ceramic surfaces such as the refractory materials. Suitable airless spray systems are available from Graco (of Mineapolis, Minn.). Suitable HVLP spray systems, which are desirable for metal/alloy process tubes, are available from G.H. Reed Inc. (of Hanover, Pa.). A high speed agitator may be desirable. Suitable spray gun tips may be selected to provide the proper thickness without undue experimentation.

Controlling the coverage density may be critical to coating performance. Dry coating thickness should be from about two (2) mils (about 50 microns (μ)) to about ten (10) mils (about 2550, depending upon typed, size and condition of substrate. One (1) mil equals 25.4μ. Proper thickness may vary. If possible, rotate the part 90 degrees at least once to maintain even coverage. Allow 1 to 4 hours of dry time before the part, or installed piece, is handled depending upon humidity and temperature.

Prior to application of a thermal protective coating to the prepared surface, thermal protective coating should be thoroughly remixed to ensure all settled solids and clumps are completely redispersed. Also, the remixed thermal protective coating should be used promptly after remixing to minimize settling. To mix, a high speed/high shear dispersion blade should be attached to a hand drill of sufficient power with a minimum speed of 2300 rpm. Dispersion blades can be purchased from numerous suppliers. The thermal protective coating is prepared by mixing at high speed while moving the blade up and down inside the coating's container to ensure complete redispersion for a minimum of 10 minutes. Alternative equivalent mixing procedures may be used.

It is desirable to apply the thermal protective coating to the surface directly after cleaning the surface so minimal surface oxidation occurs. The prepared surface should be at, or near, room temperature (60° F. to 80° F.) and humidity should be below 50%, if possible.

Spray equipment which may be used include a high volume low pressure (HPLV) spray gun, which should be used with 20-40 psi of clean, oil free air. Other types of spray equipment may be suitable, as well, including airless spray equipment. Controlling the coverage density is desirable to enhance coating performance. If possible, the support layer, or the spray equipment, should be rotated 90 degrees at least once to maintain even coverage. Never reapply after the coat has completely dried. Allow 2 to 4 hours of dry time before the radiant tube (12) is handled depending upon humidity and temperature.

Example 1 is composed of sodium silicate 20%, Min-u-Sil 34.5%, Boron Carbide 7.5%, polar gel 0.5%, and deionized water 37.5%. When dry example 1 has sodium silicate 32%, Min-u-Sil 55.2%, boron carbide 12%, and polar gel 0.8%.

Example 2 is composed of sodium silicate 20%, min-u-sil 5 39.5%, boron silicide 2.5%, polar gel 0.5%, and deionized water 37.5%. When dry example 2 has sodium silicate 15%, Min-u-Sil 79%, boron silicide 5%, and polar gel 1.0%.

Example 3 is composed of sodium silicate 20%, Min-u-Sil 34.5%, boron silicide 1.5%, boron carbide 6.0%, polar gel 0.5%, and deionized water 37.5%. When dry example 2 has sodium silicate 15%, min-u-sil 69%, boron silicide 3%, boron carbide 12%, and polar gel 1.0%.

It is to be understood that the present invention is not limited to the embodiments described above, but encompasses any and all embodiments within the scope of the following claims.

What is claimed is:

1. A radiant tube assembly (12), comprising:

at least one tubular structure (14, 16, 22, or 24), each tubular structure (14, 16, 22, or 24) having a length and an external surface (15) exposed along the length thereof, and a thermal protective layer (18) disposed upon at least one external surface (15) thereof, wherein the thermal protective layer (18) has a. from about 5% to about 40% of an inorganic adhesive, from about 45% to about 92% of a filler, and from about 1% to about 20% of one or more emissivity agents; or b. from about 5% to about 60% of colloidal silica, colloidal alumina, or combinations thereof; from about 23% to about 79% of a filler; and from about 1% to about 20% of one or more emissivity agents.

2. The radiant tube assembly (12) of claim 1, wherein:

the at least one tubular structure (14, 16, 22, or 24) has an inner tubular structure (14, 22, or 24) and an outer tubular structure (16), the inner tubular structure (14, 22, or 24) is in thermal communication with a heat source (30) and has an exposed exterior surface (15), and the outer tubular structure (16) encompasses the inner tubular structure (14, 22, or 24) and has an exposed interior surface (17) and an exterior surface (15), wherein the exterior surface (15) of the inner tubular structure (14, 22, or 24) and the interior surface (17) of the outer tubular structure (16) are spaced apart permitting gaseous flow therebetween.

3. The radiant tube assembly (12) of claim 2, wherein:

at least one additional tubular structure (22) is disposed therein encompassing the inner tubular structure (14) and being encompassed by the outer tubular structure (16) such that each additional tubular structure (14, 22, or 24) has exposed interior and exterior surfaces (17 and 15) permitting gaseous flow therebetween each tubular structure (14, 16, 22, and 24).

4. The radiant tube assembly (12) of claim 2, wherein:

the outer tubular structure (16) has an open end (19) and a closed end (21) disposed opposite the open end (19).

5. The radiant tube assembly (12) of claim 2, wherein:
the outer tubular structure (16) has opposing open ends (19 and 32) permitting gaseous flow therethrough.

6. The radiant tube assembly (12) of claim 2, wherein:
the inner tubular structure (14) has an open end and a closed end disposed opposite the open end wherein a gaseous radiant heat source (30) is disposed on the open end for injecting radiant heat therein.

7. The radiant tube assembly (12) of claim 2, wherein:
the inner tubular structure (14) has opposing open ends permitting gaseous flow therethrough wherein one end receives (30) a gaseous radiant heat source therethrough and the opposite end thereof exhausts (32) the gaseous radiant heat therefrom.

8. The radiant tube of claim 1, further comprising:
a reflector (26) disposed along an exposed surface (25-15), wherein the reflector (26) has an interior side (25) and an exterior side (27), the interior side (25) adjacent the exposed surface (25-15) to reflect radiant heat.

9. The radiant tube assembly (12) of claim 1, further comprising:
a thermal protective layer (18) disposed on at least one side (25 or 27) of the reflector (26).

10. The radiant tube assembly (12) of claim 1, wherein:
the at least one external surface (15), having a thermal protective layer (18) thereon, comprises a metallic substrate or a ceramic substrate.

11. The radiant tube assembly (12) of claim 10, wherein:
the metallic substrate is taken from the group consisting of steel, low carbon steel, stainless steel, cast iron, iron, aluminum, and alloys, and combinations thereof.

12. The radiant tube assembly (12) of claim 1, wherein:
the thermal protective layer (18) further comprises
from about 1.0% to about 5.0% of a stabilizer;
from about 1.0% to about 5.0% of a stabilizer taken from the group consisting of bentonite, kaolin, magnesium alumina silica clay, tabular alumina, and stabilized zirconium oxide;
up to about 1.0% of a surfactant;
a colorant; or
combinations thereof.

13. The radiant tube assembly (12) of claim 1, wherein:
the inorganic adhesive is taken from the group consisting of an alkali/alkaline earth metal silicate taken from the group consisting of sodium silicate, potassium silicate, calcium silicate, and magnesium silicate;
the filler is taken from the group consisting of silicon dioxide, aluminum oxide, titanium dioxide, magnesium oxide, calcium oxide, and boron oxide;
the one or more emissivity agents are taken from the group consisting of boron carbide, silicon tetraboride, silicon hexaboride, silicon carbide, molybdenum disilicide, tungsten disilicide, zirconium diboride, cupric chromite, and metallic oxides;
the emissivity agents are a metal oxide taken from the group consisting of iron oxide, magnesium oxide, manganese oxide, chromium oxide, and derivatives thereof; or
combinations thereof.

14. The radiant tube assembly (12) of claim 1, wherein:
the thermal protective layer (18) contains
a. from about 5% to about 40% of an inorganic adhesive, the inorganic adhesive is taken from the group consisting of an alkali/alkaline earth metal silicate taken from the group consisting of sodium silicate, potassium silicate, calcium silicate, and magnesium silicate; from about 45% to about 92% of a filler, the filler taken from the group consisting of silicon dioxide, aluminum oxide, titanium dioxide, magnesium oxide, calcium oxide, and boron oxide; and from about 1% to about 20% of one or more emissivity agents taken from the group consisting of boron carbide, silicon tetraboride, silicon hexaboride, silicon carbide, molybdenum disilicide, tungsten disilicide, zirconium diboride, cupric chromite, and metallic oxides;
b. from about 5% to about 60% of colloidal silica, colloidal alumina, or combinations thereof; from about 23% to about 79% of a filler taken from the group consisting of silicon dioxide, aluminum oxide, titanium dioxide, magnesium oxide, calcium oxide, and boron oxide; and from about 1% to about 20% of one or more emissivity agents taken from the group consisting of boron carbide, silicon tetraboride, silicon hexaboride, silicon carbide, molybdenum disilicide, tungsten disilicide, zirconium diboride, cupric chromite, and metallic oxides;
c. from about 5% to about 40% of an inorganic adhesive, the inorganic adhesive taken from the group consisting of an alkali/alkaline earth metal silicate taken from the group consisting of sodium silicate, potassium silicate, calcium silicate, and magnesium silicate; from about 45% to about 92% of a filler, the filler taken from the group consisting of silicon dioxide, aluminum oxide, titanium dioxide, magnesium oxide, calcium oxide, and boron oxide; and from about 1% to about 20% of one or more emissivity agents taken from the group consisting of silicon hexaboride, boron carbide, silicon tetraboride, silicon carbide, molybdenum disilicide, tungsten disilicide, zirconium diboride, cupric chromite, and metallic oxides; and from about 1% to about 5% of a stabilizer taken from the group consisting of bentonite, kaolin, magnesium alumina silica clay, tabular alumina, and stabilized zirconium oxide; or
d. from about 5% to about 60% of colloidal silica, colloidal alumina, or combinations thereof; from about 23% to about 79% of a filler taken from the group consisting of silicon dioxide, aluminum oxide, titanium dioxide, magnesium oxide, calcium oxide, and boron oxide; and from about 1% to about 20% of one or more emissivity agents taken from the group consisting of boron carbide, silicon tetraboride, silicon hexaboride, silicon carbide, molybdenum disilicide, tungsten disilicide, zirconium diboride, cupric chromite, and metallic oxides; and from about 1% to about 5.0% of a stabilizer taken from the group consisting of bentonite, kaolin, magnesium alumina silica clay, tabular alumina, and stabilized zirconium oxide.

15. The radiant tube assembly (12) of claim 1, further comprising:
from about 2% to about 20% of a first emissivity agent taken from the group consisting of, boron carbide, silicon carbide powder, silicon tetraboride, molybdenum disilicide, tungsten disilicide, zirconium diboride, cupric chromite, and metal oxides; and from about 0.5% to about 3.5% of a second emissivity agent taken from the grouped consisting of silicon hexaboride.

16. A method of manufacturing a radiant tube assembly (12) having a thermal protective layer (18), comprising:
providing at least one tubular structure (14, 16, 22, or 24), each tubular structure (14, 16, 22, or 24) having a length and a surface (15 or 17) exposed along the length thereof
wherein the exposed surface (15 or 17) is on an interior surface (17), or on an exterior surface (15), or on combinations thereof;

mixing a thermal protective coating containing a. from about 6% to about 40% of an inorganic adhesive, from about 23% to about 56% of a filler, from about 0.5% to about 15% of one or more emissivity agents, and from about 18% to about 50% water, or b. from about 15% to about 60% of colloidal silica, colloidal alumina, or combinations thereof; from about 23% to about 55% of a filler, from about 0.5% to about 15% of one or more emissivity agents, and from about 10% to 50% water; and applying the mixed thermal protective coating to the exposed exterior surface (15) using a spray gun to form a thermal protective layer (18) from about 2 mils (5 microns) to about 10 mils (254 microns) thick.

17. The method of claim 16, further comprising:

the thermal protective layer (18) further comprises from about 0.5 percent to about 2.4 percent of a stabilizer;

up to about 1.0% of a surfactant;

from about 0.5 percent to about 2.4 percent of a stabilizer taken from the group consisting of bentonite, kaolin, magnesium alumina silica clay, tabular alumina, and stabilized zirconium oxide;

a colorant; or combinations thereof.

18. The method of claim 16, wherein:

the inorganic adhesive is taken from the group consisting of an alkali/alkaline earth metal silicate taken from the group consisting of sodium silicate, potassium silicate, calcium silicate, and magnesium silicate;

the filler is taken from the group consisting of silicon dioxide, aluminum oxide, titanium dioxide, magnesium oxide, calcium oxide, and boron oxide;

the one or more emissivity agents are taken from the group consisting of boron carbide, silicon tetraboride, silicon hexaboride, silicon carbide, molybdenum disilicide, tungsten disilicide, zirconium diboride, cupric chromite, and metallic oxides;

the emissivity agents are a metal oxide taken from the group consisting of iron oxide, magnesium oxide, manganese oxide, chromium oxide, and derivatives thereof; or combinations thereof.

19. The method of claim 16, wherein:

the spray gun is taken from the group consisting of an high volume low pressure spray gun or an airless spray gun.

20. The method of claim 16, further comprising:

agitating the solution of thermal protective coating prior to applying;

rotating the direction of spray to facilitate an even thickness;

preparing the exposed surface first by;

cleaning, grit blasting, or combinations thereof;

allowing the thermal protective layer (18) to air dry from about two to about four hours;

applying the mixed thermal protective coating to the exposed interior surface (17) using a spray gun to form a thermal protective layer (18) from about 2 mils (5 microns) to about 10 mils (254 microns) thick; or combinations thereof.

21. The method of claim 16, wherein:

the exposed surface comprises a metallic substrate or a ceramic substrate.

* * * * *